US006641373B2

(12) United States Patent
Morita

(10) Patent No.: US 6,641,373 B2
(45) Date of Patent: Nov. 4, 2003

(54) GAS COMPRESSOR WITH VARIABLY BIASED VANES

(75) Inventor: Keiichi Morita, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 10/082,741

(22) Filed: Feb. 22, 2002

(65) Prior Publication Data

US 2002/0119054 A1 Aug. 29, 2002

(30) Foreign Application Priority Data

Feb. 28, 2001 (JP) ..... 2001-055133
Jan. 23, 2002 (JP) ..... 2002-014726

(51) Int. Cl.[7] ..... F04B 49/00; F04B 17/00; F01C 1/00

(52) U.S. Cl. ..... 417/310; 417/410.3; 418/268

(58) Field of Search ..... 417/310, 410.3; 418/93, 268

(56) References Cited

U.S. PATENT DOCUMENTS 2,809,593 A 10/1957 Klessig et al. ..... 103/136
4,455,129 A 6/1984 Sakitani et al. ..... 418/82
4,516,920 A * 5/1985 Shibuya ..... 418/23
4,543,049 A * 9/1985 Shibuya ..... 418/269
4,867,658 A * 9/1989 Sugita et al. ..... 418/76
4,936,761 A * 6/1990 Hasegaki et al. ..... 418/84
4,986,741 A * 1/1991 Nakajima et al. ..... 418/268
6,015,278 A * 1/2000 Key et al. ..... 418/82

* cited by examiner

*Primary Examiner*—Charles G. Freay
*Assistant Examiner*—Timothy P. Solak
(74) *Attorney, Agent, or Firm*—Adams & Wilks

(57) ABSTRACT

To provide a gas compressor in which saving of power as well as improved compression performance and durability are attained by enabling reduction of vane back pressure without degrading the projectability of the vanes upon starting operation of the compressor. Scoop grooves and a high pressure supply hole are arranged so as to be spaced apart from each other, and the interval therebetween is set to an interval sufficient to ensure that a vane groove is communicated with neither the scoop grooves nor the high pressure supply hole while the vane groove moves apart from the scoop grooves toward the high pressure supply hole. Further, if there has occurred a reversed pressure relationship between a suction chamber (low-pressure chamber) and a discharge chamber (high-pressure chamber), a pressure control valve is actuated upon starting operation of the compressor to interconnect the scoop groove with the suction chamber side.

14 Claims, 12 Drawing Sheets

ACTUAL MEASUREMENT VALUES OBTAINED WITH A GAS COMPRESSO R HAVING A DISCHARGE CAPACITY OF 72 (CC/REV)

CLOSED STATE

OPENED STATE

Prior Art

GAS COMPRESSOR WITH VARIABLY BIASED VANES

BACKGROUND OF THE INVENTION

1. Field of the Invention

The present invention relates to a gas compressor of a vane rotary type for use in a car air conditioner system, and more particularly to a gas compressor in which vane back pressure can be reduced without degrading projectability of the vanes upon starting operation of the compressor.

2. Description of the Related Art

Conventionally, as shown in FIG. 10 and FIG. 11, in a gas compressor of such a vane rotary type, the interior of a cylinder 4 is partitioned into a plurality of small chambers by being defined by the cylinder 4, side blocks 5 and 6, a rotor 7, and vanes 12. Each of the thus partitioned small chambers functions as a compression chamber 13 for executing compression of a refrigerant gas.

That is, the volume of each compression chamber 13 alternately increases and decreases as the rotor 7 rotates, and a refrigerant gas in a suction chamber 14 is sucked up and compressed due to the variations in the volume and then discharged into a discharge chamber 15 side. In the course of such suction, compression, and discharge of the refrigerant gas, the vanes 12 slide within a vane groove 11 of the rotor 7 and is projected from the outer peripheral surface of the rotor 7 toward the inner peripheral surface of the cylinder 4.

Also, during the process of suction and compression, oil having a pressure lower than a discharge pressure Pd of the refrigerant gas is supplied as vane back pressure from scoop grooves 22, 23 of the front-side side block 5 and the rear-side side block 6 into the bottom portion of the vane groove 11. Then, the vanes 12 is pushed onto the inner peripheral surface of the cylinder 4 due to this vane back pressure and a centrifugal force generated by the rotation of the rotor 7.

Note that, when the process shifts from the compression of the refrigerant gas to discharge thereof, the pressure in the compression chamber 13 increases due to the pressure of the compressed refrigerant gas, and the increased pressure acts to push back the vanes 12 into the vane groove 11 so that the vanes 12 are moved away from the inner peripheral surface of the cylinder 4. To avoid this problem, the bottom portion of the vane groove 11 communicates with a high pressure supply hole 24 of the rear-side side block 6 at a time immediately before the discharge of the refrigerant gas, and then high-pressure oil having a pressure equivalent to the discharge pressure Pd is supplied as vane back pressure from the high pressure supply hole 24 into the bottom portion of the vane groove 11.

However, in the conventional gas compressor as described above, although the scoop grooves 22, 23 and the high pressure supply hole 24 are arranged separately from each other, as shown in FIG. 12, the scoop grooves 22, 23 and the high pressure supply hole 24 are communicated with each other via the vane groove 11 during the time when the vane groove 11 moves apart from the scoop grooves 22, 23 toward the high pressure supply hole 24 side. Thus, high-pressure oil flows into the scoop grooves 22, 23 side from the high pressure supply hole 24 via the vane groove 11, and the oil pressures within the scoop grooves 22, 23 are thus likely to increase. Therefore, the vane back pressure can readily rise upon starting the operation of the compressor, and the projectability of the vanes 12 is thus improved. However, during a steady operation of the compressor, the vane back pressure becomes excessively high, which results in such problems that not only is abrasion of the vanes 12 increased but also the power required for operating the compressor is increased.

The present invention has been made in view of the above problems, and therefore an object thereof is to provide a gas compressor in which power saving as well as improved compression performance and durability are attained by enabling reduction of the vane back pressure without degrading the projectability of the vanes upon starting the operation of the compressor.

SUMMARY OF THE INVENTION

In order to attain the above object, according to the present invention, there is provided a gas compressor comprising: a cylinder having side blocks attached to its end surface; a rotor rotatably disposed within the cylinder; vanes which slide within a vane groove that is formed on an outer peripheral surface of the rotor and which is arranged so as to be projectable from an outer peripheral surface of the rotor toward an inner peripheral surface of the cylinder; a compression chamber constituted by a small chamber that is partitioned off and defined in the interior of the cylinder by the cylinder, the side blocks, the rotor, and the vanes, which alternately increases and decreases in volume as the rotor rotates, and sucks in and compress a refrigerant gas in a low-pressure chamber due to the volume variation and then discharges it into a high-pressure chamber side; a scoop groove with which a bottom portion of the vane groove communicates during a suction and compression process of the coolant gas, and from which a vane back pressure is supplied into the bottom portion of the vane groove; a high pressure supply hole with which the bottom portion of the vane groove communicates at a time immediately before discharge of the coolant gas, and from which a vane back pressure having a pressure higher than that of the vane back pressure supplied from the scoop groove is supplied into the bottom portion of the vane groove; and a pressure control valve which interconnects the scoop groove with the low-pressure chamber side when there has occurred a reversed pressure relationship between the low-pressure chamber and the high-pressure chamber, wherein the scoop groove and the high pressure supply hole are arranged so as to be spaced apart from each other, and an interval therebetween is set to an interval sufficient to ensure that the vane groove is communicated with neither the scoop groove nor the high pressure supply hole during the time when the vane groove moves apart from the scoop groove toward the high pressure supply hole.

Therefore, since the present invention adopts the above structure, the vane groove is communicated with neither of the scoop groove and the high pressure supply hole during the time when it moves apart from the scoop groove toward the high pressure supply hole. Thus, it is possible to prevent a situation such that high-pressure oil flows into the scoop groove side from the high pressure supply hole side through the vane groove during a steady operation of the compressor. Further, when the operation of the compression is started, if there exists a reversed pressure relationship between the high-pressure chamber and the low-pressure chamber, the pressure control valve is actuated to introduce a relatively high pressure gas from the low-pressure chamber into the scoop groove side through the communication passage, thereby attaining an effect that the pressure within the scoop groove and the vane back pressure can readily rise upon starting the operation of the compressor.

According to the present invention, for the pressure control valve described above, there may be adopted a structure such that the pressure control valve includes: a communication passage communicating the suction chamber with the scoop groove; a hole having a shape of a circular truncated cone, which is arranged as a valve seat portion on a way of the communication passage; a valve body which is movably disposed within the communication passage and which is formed such that it may be fitted into the hole having a shape of a circular truncated cone; and a width extending means for partially extending a width of a minute gap between the valve body and the communication passage, in which when the pressure in the suction chamber has become higher than the pressure in the scoop groove, the valve body is moved apart from the hole having a shape of a circular truncated cone due to a pressure difference to thereby set the communication passage in an opened state, whereas when the pressure in the scoop groove has risen to exceed the pressure in the suction chamber, the valve body is pushed back into close contact with the hole having a shape of a circular truncated cone due to a pressure difference to thereby set the communication passage in a closed state.

For the pressure control valve described above, there may be adopted an alternative structure such that the pressure control valve includes: a communication passage communicating the suction chamber with the scoop groove; a hole having a shape of a circular truncated cone, which is arranged as a valve seat portion on a way of the communication passage; a valve body which is movably arranged within the communication passage and which is formed such that it may be fitted into the hole having a shape of a circular truncated cone; and a biasing means that constantly biases the valve body in a direction to move the valve body away from the hole having a shape of the circular truncated cone, in which when the pressure in the suction chamber becomes higher than the pressure in the scoop groove, the valve body is moved apart from the hole having a shape of a circular truncated cone due to a pressure difference to thereby set the communication passage in an opened state, whereas when the pressure in the scoop groove has risen to exceed the pressure in the suction chamber, the valve body is pushed back into close contact with the hole having a shape of a circular truncated cone due to a pressure difference to thereby set the communication passage in a closed state.

For the pressure control valve described above, there may be adopted an alternative structure such that the pressure control valve includes: a communication passage communicating the suction chamber with the scoop groove; a hole having a shape of a circular truncated cone, which is arranged as a valve seat portion on a way of the communication passage; a valve body which is movably arranged within the communication passage and which is formed such that it may be fitted into the hole having a shape of a circular truncated cone; a width extending means for partially extending a width of a minute gap between the valve body and the communication passage; and a biasing means that constantly biases the valve body in a direction to move the valve body away from the hole having a shape of the circular truncated cone, in which when the pressure in the suction chamber becomes higher than the pressure in the scoop groove, the valve body is moved apart from the hole having a shape of a circular truncated cone due to a pressure difference to thereby set the communication passage in an opened state, whereas when the pressure in the scoop groove has risen to exceed the pressure in the suction chamber, the valve body is pushed back into close contact with the hole having a shape of a circular truncated cone due to a pressure difference to thereby set the communication passage in a closed state.

According to the present invention, the following may be adopted as constituting the width extending means: 1) means for extending the width of the minute gap in an upper region thereof, out of the entire area of the minute gap; 2) means for extending the width of the minute gap at several locations; 3) a groove formed on an inner wall of the communication passage along a direction of movement of the valve body; 4) a groove formed on an outer peripheral surface of the valve body; and so on.

According to the present invention, a biasing force applied by the biasing means may be set to be greater than an adhesive force of an oil film to adhere the valve body to the hole having a shape of a circular truncated cone.

BRIEF DESCRIPTION OF THE DRAWINGS

FIG. 5A is a cross sectional view of the pressure control valve and FIG. 5B is a cross sectional view of 5A taken along a line B—B.

FIG. 6A is a cross sectional view of the pressure control valve and FIG. 6B is a cross sectional view of 6A taken along a line B—B.

FIG. 7A is a cross sectional view of the pressure control valve and FIG. 7B is a cross sectional view of 7A taken along a line B—B.

FIG. 8A is a cross sectional view of the pressure control valve and FIG. 8B is a cross sectional view of 8A taken along a line B—B.

FIG. 9A is cross sectional view showing an operation for opening the pressure control valve and FIG. 9B is cross sectional view showing an operation for closing the pressure control valve.

DESCRIPTION OF THE PREFERRED EMBODIMENT

Hereinafter, an embodiment of a gas compressor according to the present invention will be described in detail with reference to FIG. 1 to FIG. 9. Note that, portions thereof that are identical to those of the conventional structure will be described using FIG. 11.

Figure 1:
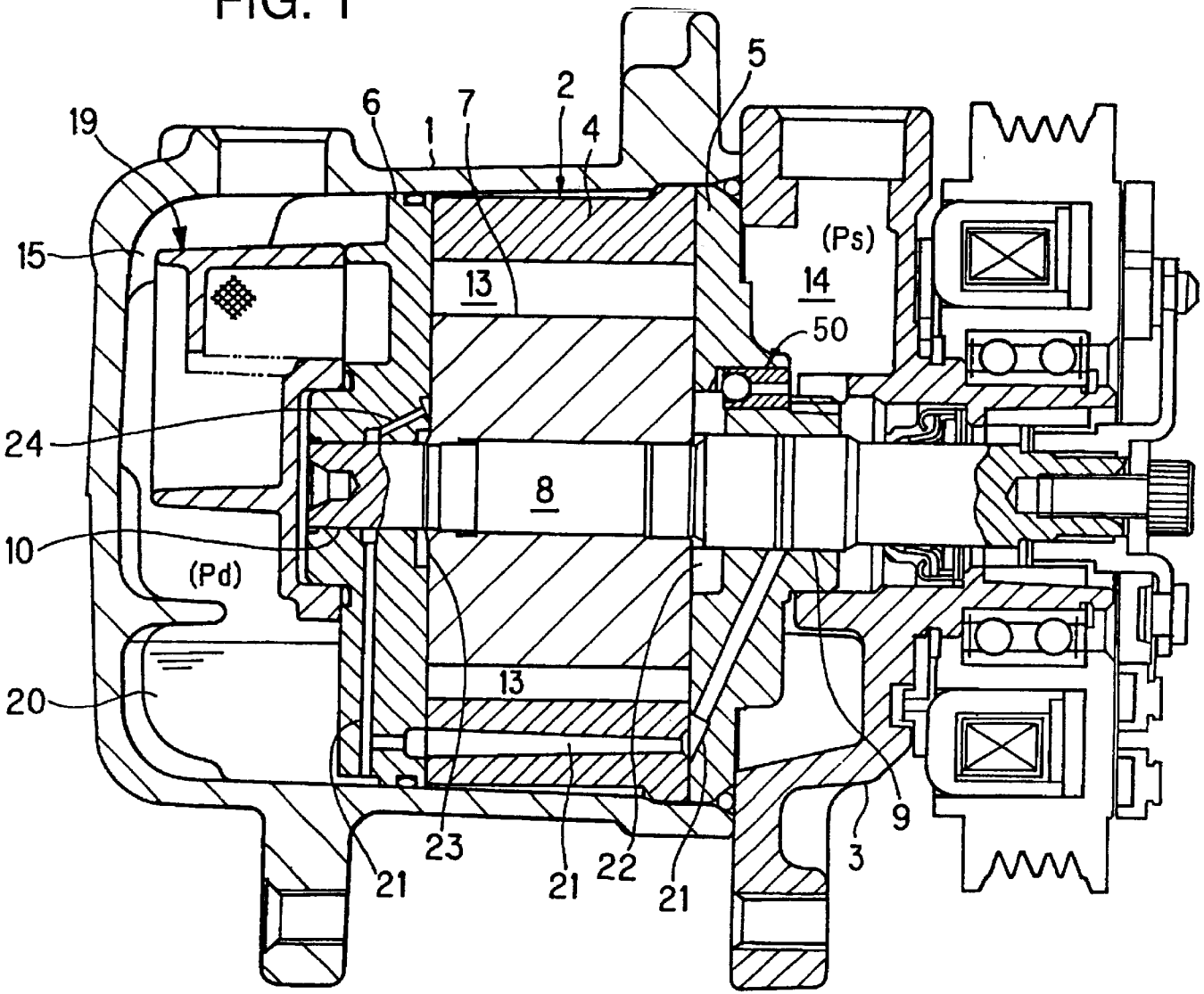
FIG. 1 is a cross sectional view of a gas compressor according to one embodiment of the present invention.

The gas compressor of the present embodiment has a structure in which, as shown in FIG. 1, a compression mechanism portion 2 is accommodated in a compressor case 1 having one open end, and a front head 3 is attached to the one open end of the compressor case 1.

The compression mechanism portion 2 includes a cylinder 4 whose inner periphery is elliptical, and side blocks 5 and 6 are attached to both end surfaces of the cylinder 4. Also, a rotor 7 is disposed within the cylinder 4. The rotor 7 is rotatably disposed therein by means of a rotor shaft 8 that is provided integrally with an axial center thereof, and bearings 9 and 10 of the side blocks 5 and 6 which support the rotor shaft 8.

Figure 11:
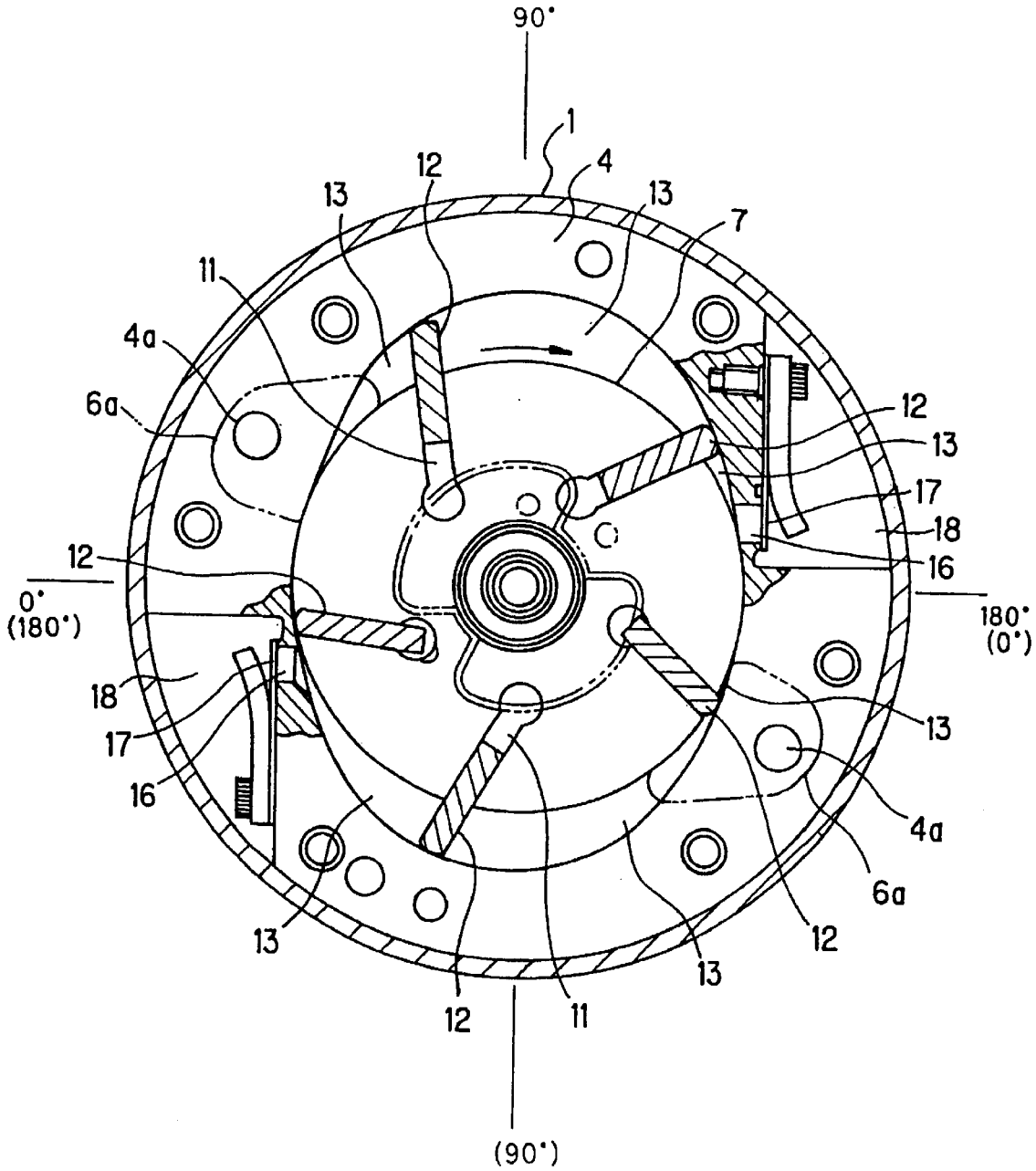
FIG. 11 is a cross sectional view of FIG. 10 taken along a line B—B.
Figure 12:
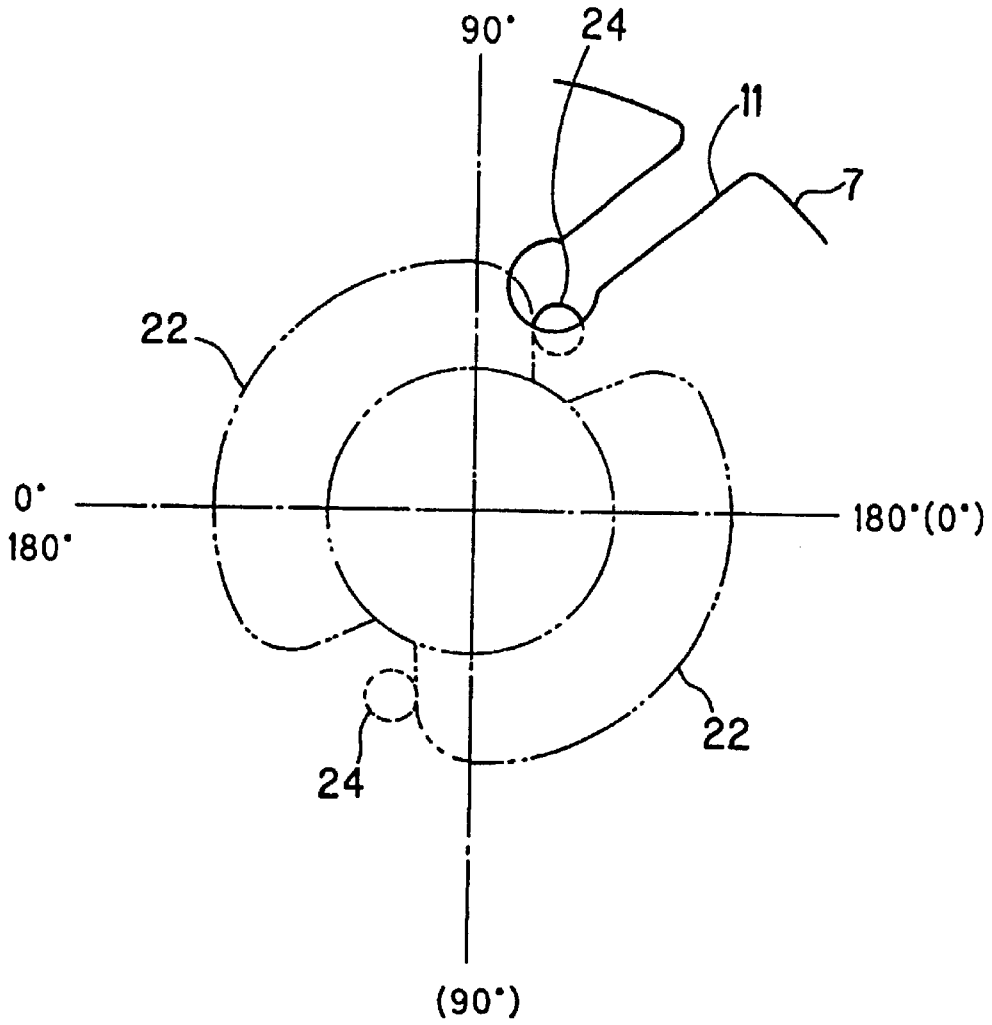
FIG. 12 is a view for explaining the positional relationship between a vane groove and a scoop groove in the conventional gas compressor shown in FIG. 10.

Turning to FIG. 11 for further description, five slit-like vane grooves 11 are cut out on the outer peripheral surface of the rotor 7 and vanes 12 are fitted in each of these vane grooves 11. Each of the vanes 12 slides within the vane groove 11 and is disposed in such a way as to project from the outer peripheral surface of the rotor 7 toward an inner peripheral surface of the cylinder 4.

The interior of the cylinder 4 is partitioned into a plurality of small chambers each being defined by an inner wall of the cylinder 4, inner surfaces of the side blocks 5 and 6, the outer peripheral surface of the rotor 7 and both side surfaces on the tip end side of the vanes 12. Each of the thus partitioned small chambers constitutes a compression chamber 13. The volume of the compression chamber 13 alternately increases and decreases as the rotor 7 rotates in a direction indicated by an arrow in the drawing. Refrigerant gas in a suction chamber 14, which is a low-pressure chamber, is thus sucked in due to the volume variations to be compressed and discharged into a discharge chamber 15 side as a high-pressure chamber.

That is, when a volume change of the compression chamber 13 occurs, low-pressure refrigerant gas in the suction chamber 14 is sucked into the compression chamber 13 during an increase phase of the volume, through a suction port of the side block 5 (not shown in the drawing), and a suction passage 4*a* in the cylinder 4 and a suction port 6*a* of the side block 6. Then, when the volume of the compression chamber 13 starts to decrease, compression of the refrigerant within the compression chamber 13 is started due to the effect of the volume decrease. Thereafter, when the volume of the compression chamber 13 approaches the minimum volume, a reed valve 17 of a cylinder discharge hole 16 that is located near short diameter portion of the cylinder ellipse is opened due to the pressure of the compressed high-pressure refrigerant gas. Thus, the high-pressure refrigerant gas within the compression chamber 13 is discharged into a discharge chamber 18 formed in the outside of the cylinder through the cylinder discharge hole 16, and is further introduced to the discharge chamber 15 side from the discharge chamber 18 via an oil separator 19 and the like.

Oil used for lubrication and the like is contained in a form of mist within the high-pressure refrigerant gas discharged into the discharge chamber 18. Such oil components of the high-pressure refrigerant gas are separated and captured when the refrigerant gas passes through the oil separator 19, and are dropped onto an oil pool 20 located at the bottom portion of the discharge chamber 15 and pooled therein.

The pressure of the high-pressure refrigerant gas that is discharged into the discharge chamber 15 acts on the oil pool 20 described above, so that oil reserved in the oil pool 20 on which this discharge pressure Pd acts is forcedly supplied to the rear-side bearing 10 through an oil hole 21 formed in the rear-side side block 6. Then, the oil is decompressed upon passage of the clearance of the bearing 10, and the decompressed oil flows into a rear-side scoop groove 23 to be supplied therefrom. Further, due to the pressure acting thereupon, the oil in the oil pool 20 is also forcedly supplied to the front-side bearing 9 through an oil hole 21 formed in the cylinder 4 and an oil hole 21 formed in the front-side side block 5. Then, the oil is decompressed upon passage of the clearance of the bearing 9, and the decompressed oil flows into a front-side scoop groove 22 to be supplied therefrom.

The rear-side scoop groove 23 is formed on a surface of the rear-side side block 6 which opposes the cylinder, whereas the front-side scoop groove 22 is formed on a surface of the front-side side block 5 which opposes the cylinder. Further, these two scoop grooves 22, 23 are both formed so as to oppose and communicate with a bottom portion of the vane groove 11 during suction and compression of the refrigerant gas. While the bottom portion of the vane groove 11 and the scoop grooves 22, 23 are thus being communicated with each other, low-pressure oil is supplied from the scoop grooves 22, 23 into the bottom portion of the vane groove 11 as back pressure. Note that, in this embodiment, the shape of the scoop grooves 22, 23 formed is a sector. The bottom portion of the vane groove 11 communicates with the scoop grooves 22, 23 within an angular range of from $\theta_1$ to $\theta_2$, with $\theta_1$ being an angle at which a spread of the sector starts (scoop groove starting angle) and $\theta_2$ being an angle at which the spread of the sector ends (scoop groove ending angle).

Further, a high pressure supply hole 24 is formed on a surface of the rear-side side block 6 which opposes the cylinder. The high pressure supply hole 24 is formed such that it communicates with a bottom portion of the vane groove 11 at a time immediately before discharge of the high-pressure refrigerant gas. While the bottom portion of the vane groove 11 and the high pressure supply hole 24 are thus being communicated with each other, oil having a higher pressure than that supplied to the scoop grooves 22, 23 is supplied from the high pressure supply hole 24 into the bottom portion of the vane groove 11 as vane back pressure.

Here, as the oil having a pressure higher than that supplied from the scoop grooves 22, 23, oil having a pressure equivalent to the discharge pressure Pd is used. This oil having a pressure equivalent to the discharge pressure Pd is adapted to be introduced directly to the high pressure supply hole 24 from the oil hole 21 of the read-side side block 6 without passing through clearance of the bearing 10.

Figure 2:
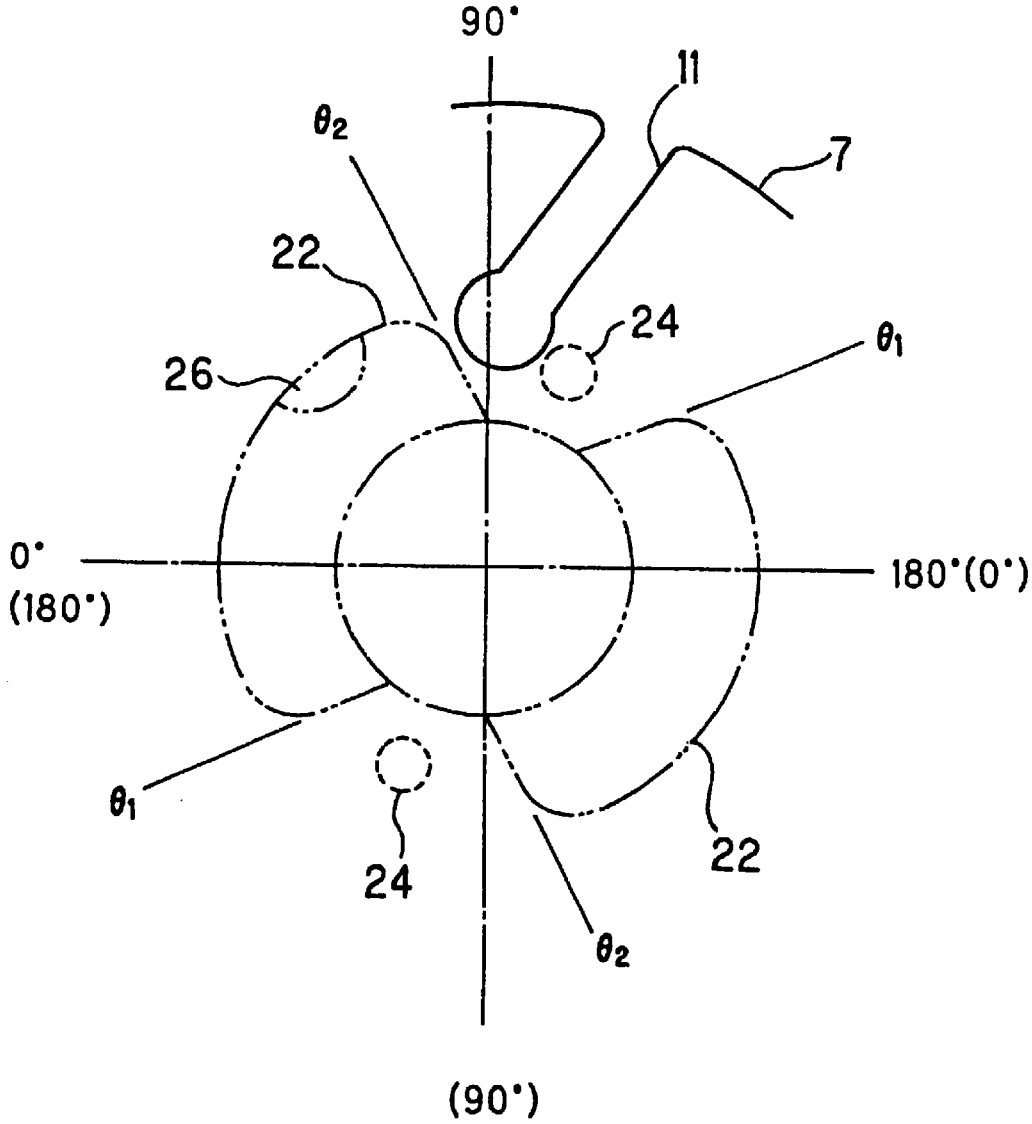
FIG. 2 is a diagram for explaining the positional relationship between a vane groove and a scoop groove in the gas compressor shown in FIG. 1.

As shown in FIG. 2, the scoop grooves 22, 23 and the high pressure supply hole 24 are disposed independently and separately while being spaced apart from each other. The space therebetween is set to an interval sufficient to ensure that the vane groove 11 is communicated with neither the scoop grooves 22, 23 nor the high pressure supply hole 24 while the vane groove 11 moves apart from the scoop grooves 22, 23 toward the high pressure supply hole 24, that is, while the suction and compression process of the refrigerant gas is being shifted to the discharge process.

As noted above, in the gas compressor according to this embodiment, while the vane groove 11 moves apart from the scoop grooves 22, 23 toward the high pressure supply hole 24, the vane groove 11 is communicated with neither the scoop grooves 22, 23 nor the high pressure supply hole 24. Therefore, it is possible to obviate the risk that high-pressure oil, that is, oil having a pressure equivalent to the discharge pressure Pd, flows from the high pressure supply hole 24 side into the scoop grooves 22, 23 side through the vane groove 11 during a steady operation of the compressor, which in turn prevents oil pressure within the scoop grooves from rising due to the high-pressure oil thus flowing thereto and a resulting increase of the vane back pressure. Also, abrasion of the vanes 12 is lessened and power required for operating the gas compressor can be reduced as well.

Further, in the gas compressor according to this embodiment, during the suction and compression process of the refrigerant gas, only an appropriate level of vane back pressure applied by the reduced-pressure oil and centrifugal force generated due to rotation of the rotor 7 act on the vanes 12 within the vane groove 11, thereby preventing excessive increase of force for urging the vanes 12 toward an inner wall of the cylinder 4. Since abrasion of the vanes 12 is lessened, durability of the apparatus is also improved.

Further, in the case where the non-interconnecting structure such as described above is adopted, when the stopped position of the vane groove 11 at least one of five upon stopping the operation of the gas compressor is located between the scoop groove 22 and the high pressure supply hole 24 as shown in FIG. 2, the bottom portion of the vane groove 11 is communicated with neither the scoop groove 22 nor the high pressure supply hole 24. Therefore, the vane back pressure at the bottom portion of the vane groove 11 can be maintained at a relatively high level during the stoppage of the gas compressor operation, and projectability of the vanes 12 upon restarting the operation of the gas compressor can be also improved.

Note that, when there is adopted the non-interconnecting structure described above, that is, the structure in which the high pressure supply hole 24 and scoop grooves 22, 23 are prevented from being communicated with each other via the vane groove 11 while the vane groove 11 moves apart from the scoop grooves 22, 23 toward the high pressure supply hole 24, there may be a fear that the projectability of the vanes 12 at the time of starting the compressor is degraded. That case is all of vane groove 11 communicated with scoop grooves 22, 23 when during the stoppage of the gas compressor operation. The projectability of the vanes 12 is particularly degraded if there exists a reversed relationship among the pressures in the suction chamber 14 (low-pressure chamber), the discharge chamber 15 (high-pressure chamber), and the scoop grooves 22, 23, that is, if the pressure in the suction chamber 14 has become higher than those in the discharge chamber 15 (high-pressure chamber) and the scoop grooves 22, 23. The reasons for this are as follows: 1) since increase in the oil pressure due to high-pressure oil flowing thereto does not occur not only in the steady operation of the compressor but also at the time of starting the operation thereof, the oil pressure within the scoop grooves 22, 23 cannot readily rise upon starting the operation of the compressor; and 2) since the pressure of the refrigerant gas sucked into the compression chamber 13 from the suction chamber 14 is relatively high and this relatively high suction pressure Ps acts upon the tip of the vanes 12, the vanes 12 are pushed back into the vane groove 11.

Accordingly, for the purpose of improving the projectability of the vanes 12 at the time of starting the operation of the compressor, a pressure control valve 50 (FBC) is provided in the gas compressor according to this embodiment, as shown in FIG. 1.

Figure 3:
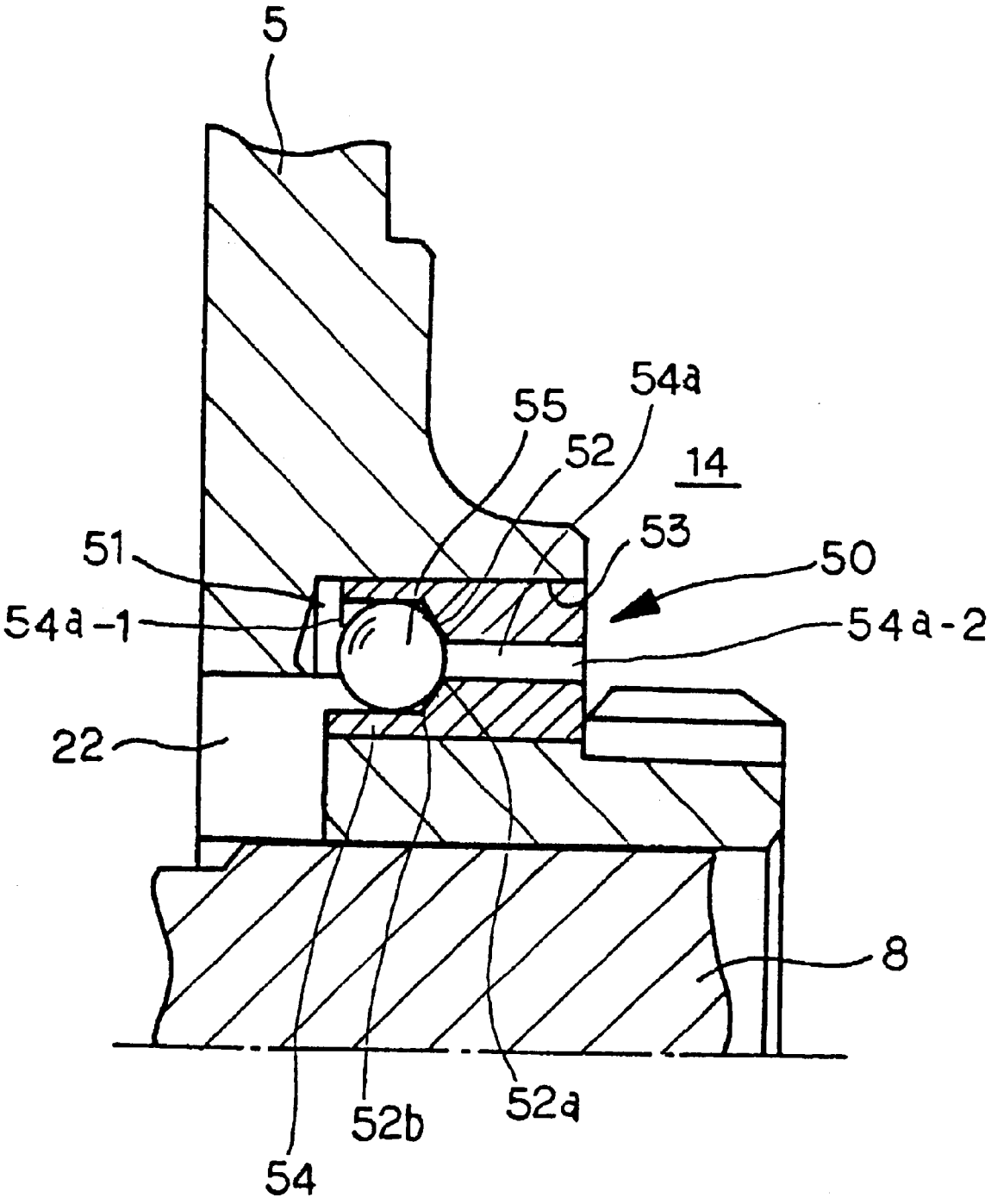
FIG. 3 is an explanatory view of a pressure control valve built in the gas compressor shown in FIG. 1.

As shown in FIG. 3, the pressure control valve 50 shown in FIG. 1 includes a communication passage 51 communicating the suction chamber 14 with the scoop groove 22 with each other, and a hole 52 having a shape of a circular truncated cone is arranged on a way of the communication passage 51 as a valve seat portion. The hole 52 having a shape of a circular truncated cone is formed such that, of both open ends thereof, a small-diameter open end 52*a* on the top portion side of the circular truncated cone is communicated with the suction chamber 14 side, and a large-diameter open end 52*b* on the bottom portion side of the circular truncated cone is communicated with the scoop groove 22 side.

There may be conceived various means for forming the communication passage 51 described above; in the pressure control valve 50 of this embodiment, a structure is adopted such that, in a through hole 53 piercing from-the suction chamber 14 to the scoop groove 22, a cylindrical bush 54 having a length substantially equal to that of the through hole 53 is disposed and the entirety of a cylinder hollow hole 54*a* of the cylindrical bush 54 is used as the communication passage 51. In the cylindrical bush 54 according to this structure, the cylinder hollow hole 54*a* is divided into two parts, namely a large-diameter hole 54*a*-1 constituting a part thereof, and a small-diameter hole 54*a*-2 constituting the front portion thereof located past the area of the large-diameter hole 54*a*-1. Further, the hole 52 having a shape of a circular truncated cone is formed at the bottom portion of the large-diameter hole 54*a*-1 and a valve body 55 having a shape of a steel ball, such as a ball valve, is movably received in the large-diameter hole 54*a*-1.

The pressure control valve 50 shown in FIG. 3 having the structure described above is actuated when there exists the aforementioned reversed pressure relationship at the time of starting the operation of the compressor. When the pressure control valve 50 is actuated, the scoop groove 23 and the suction chamber 14 are communicated with each other only at the time of starting the operation of the compressor.

That is, in the pressure control valve 50 shown in FIG. 3, when the pressure in the suction chamber 14 becomes higher than the pressures in the discharge chamber 15 and in the scoop grooves 22, 23, the valve body 55 is moved away from the valve seat portion, that is, the hole 52 having a shape of a circular truncated cone due to a pressure difference thus produced, whereby the communication path 51 is set in an open state. On the other hand,when the pressures in the discharge chamber 15 and the scoop grooves 22, 23 have risen to exceed the pressure in the suction chamber 14, the valve body 55 is pushed back into tight contact with the hole (valve seat portion) 52 having a shape of a circular truncated cone, whereby the communication passage 51 is set in a closed state.

Therefore, in the gas compressor according to this embodiment, even if there exists a reversed relationship among the pressures in the suction chamber 14, the discharge chamber 15, and the scoop grooves 22, 23 at the time of starting the operation of the compressor, the pressure control valve 50 is actuated to allow a relatively high pressure to be introduced from the suction chamber 14 into the scoop groove 23 side via a communication passage 26. Therefore, the pressure in the scoop groove 23 and the vane back pressure can readily rise, thereby attaining improved projectability of the vanes 12 at the time of starting the operation of the compressor.

Figure 4:
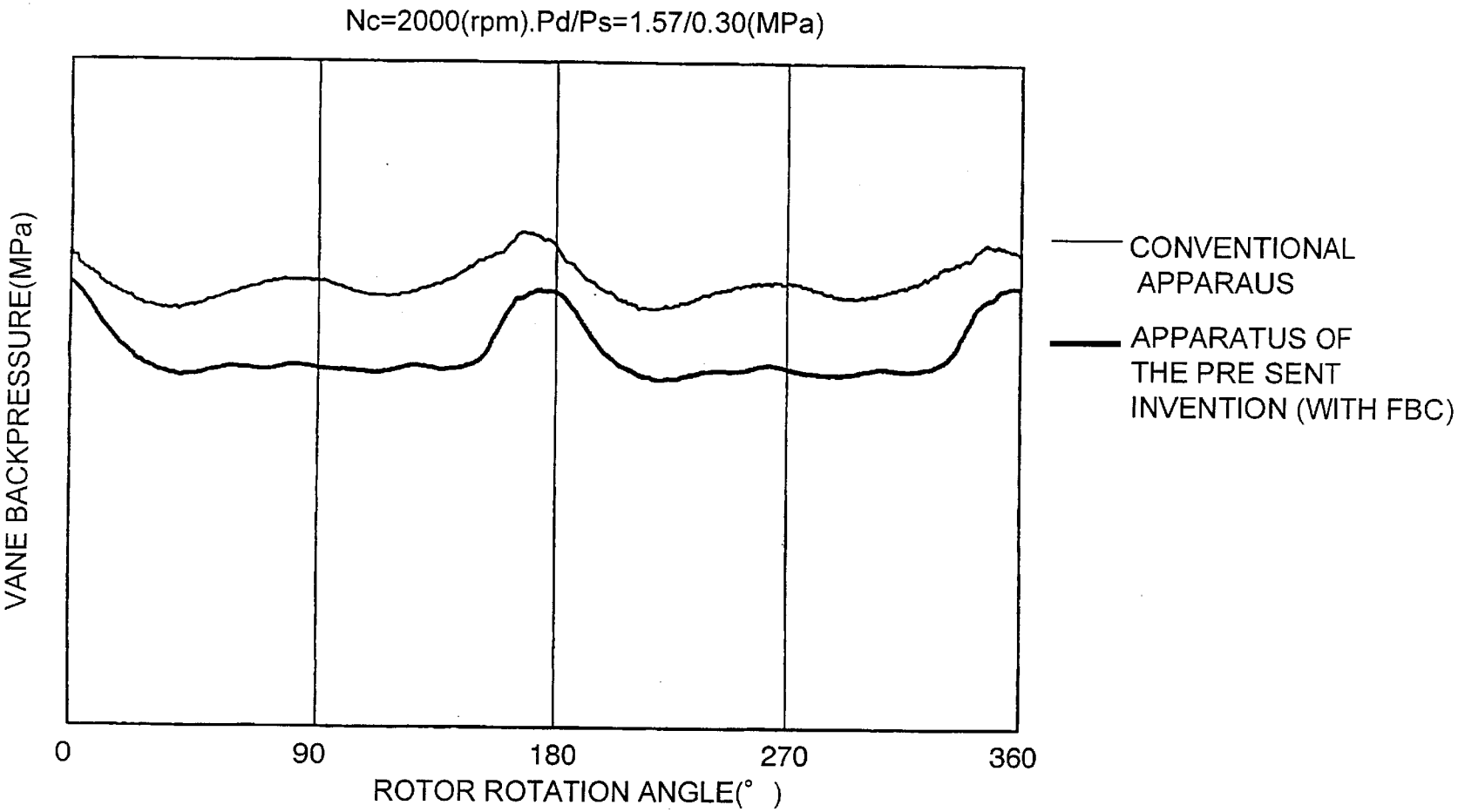
FIG. 4 is a graph indicating the results of a comparison test of vane back pressure between the gas compressor of the present invention shown in FIG. 1 and a conventional gas compressor.
Figure 10:
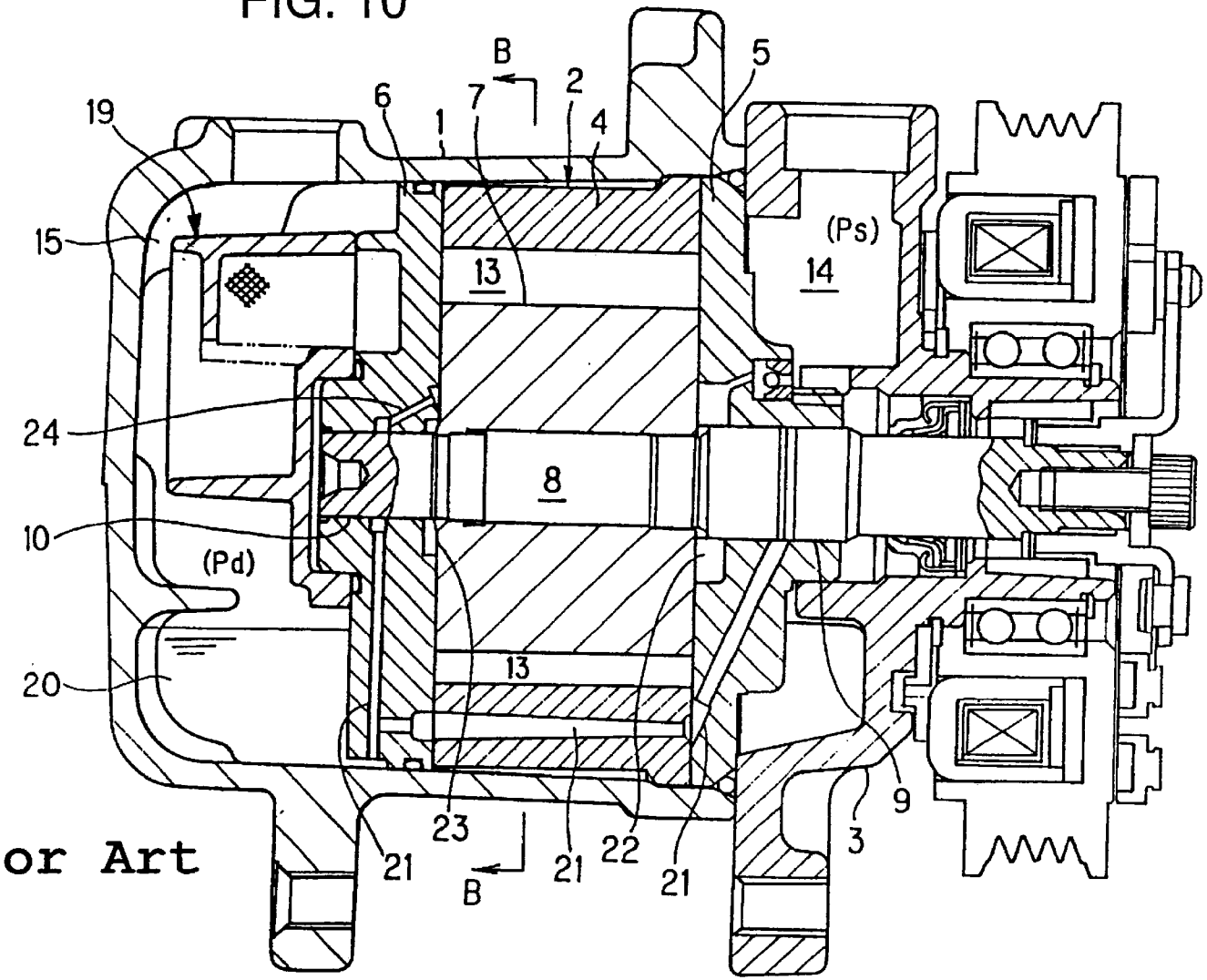
FIG. 10 Prior Art
FIG. 10 is a cross sectional view of the conventional gas compressor.

FIG. 4 illustrates results of a comparison test between the vane back pressure in the gas compressor of the present invention (apparatus of the present invention) and that in the conventional gas compressor (conventional apparatus)

shown in FIG. 10. As is apparent from the results of the comparison test, it has been found that the vane back pressure can be reduced in the apparatus of the present invention as compared with the conventional apparatus.

Figure 5B:
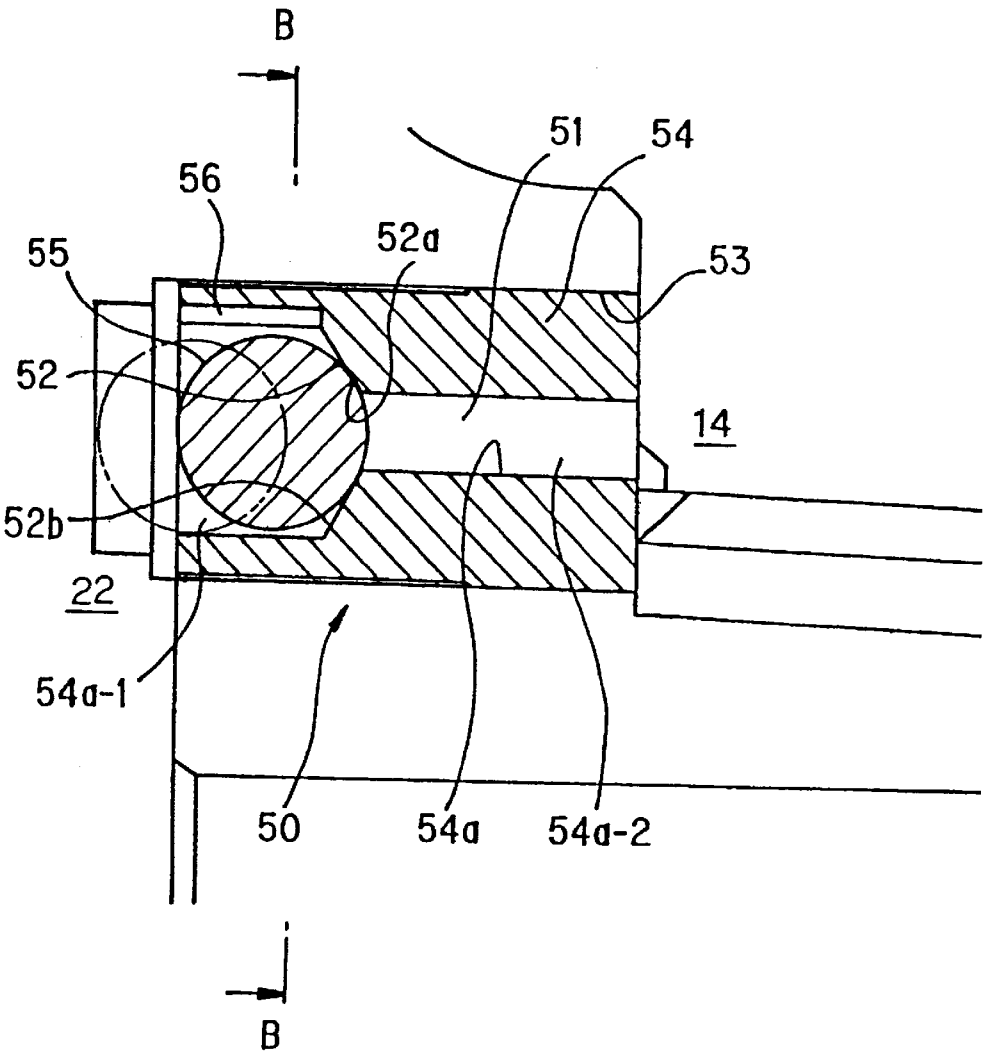
FIG. 5A and FIG. 5B are an explanatory views showing another embodiment of the pressure control valve according to the present invention.
Figure 5A:
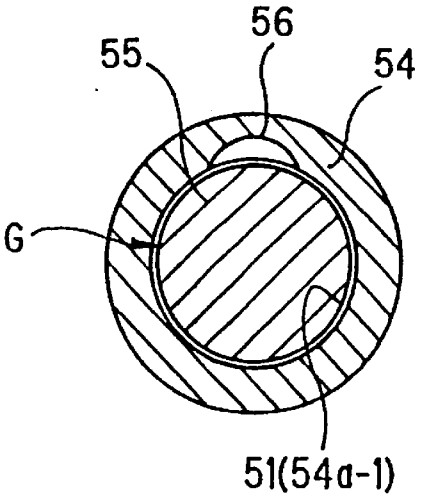

A pressure control valve 50 shown in FIGS. 5A 5B may also be employed instead of the pressure control valve 50 shown in FIG. 3.

Although a minute gap G having a size that is at least required to allow movement of the valve body 55 is formed between the valve body 55 and the communication passage 51 in each of the pressure control valves 50 shown in FIG. 3 and FIGS. 5A 5B, the pressure control valve 50 of FIGS. 5A 5B is different from the pressure control valve 50 of FIG. 3 in that a groove 56 is formed on the inner wall of the communication passage 51 as a means for partially expanding the minute gap G. The groove 56 on the inner wall of the communication passage is formed along the direction of movement of the valve body 55, and functions as a means for breaking off an oil film formed about the periphery of the valve body 55.

As regards the gas compressor shown in FIG. 1, there may be a case where the oil that lubricates within the compressor during operation of the compressor for effecting lubrication remains within the communication passage 51 of the pressure control valve 50 even after stopping an operation of the compressor. However, when the pressure control valve 50 shown in FIGS. 5A 5B is adopted, a phenomenon such that the communication passage 51 of the pressure control valve 50 is blocked by a film of the residual oil becomes less likely to occur. This is because oil can readily flow out of the communication passage 51 to the outside since the groove 56 formed on the inner wall of the communication passage 51 serves as an outflow passage for the oil. When oil remains within the communication passage 51, an oil film is formed about the periphery of the valve body 55 of the pressure control valve 50. However, the continuity of such an oil film is broken off by means of the groove 56 formed on the inner wall of the communication passage 51. Therefore, operational responsivity of the valve body 55 is improved, and a phenomenon such that the valve body 55 is stuck due to the oil film formed about the periphery of the valve body 55 becomes less likely to occur.

To attain the oil film breaking effect of the groove 56, the groove 56 to be formed on the inner wall of the communication passage may be formed in a given part of the entire minute gap G between the valve body 55 and the communication passage 51. In the pressure control valve 50 shown in FIGS. 5A 5B, there is adopted a structure in which the groove 56 on the inner wall of the communication passage is formed specifically in the upper region of the minute gap G as a whole. This is to minimize the possibility that the oil film breaking effect of the groove 56 wears off. That is, as regards the distribution state of oil within the entire minute gap G, the oil is more likely to remain in the lower region of the minute gap G due to its own weight. Thus, if the groove 56 on the inner wall of the communication passage is formed in the lower region of the minute gap G, the gap 56 can become filled up with the oil relatively quickly, and therefore there is a strong possibility that the oil film breaking effect of the groove 56 will wear off. On the other hand, if the groove 56 on the inner wall of the communication passage is formed in the upper region of the minute gap G, the oil is less likely to be accumulated in the groove 56 and therefore the oil film breaking effect of the groove 56 can be sustained permanently.

Figure 6B:
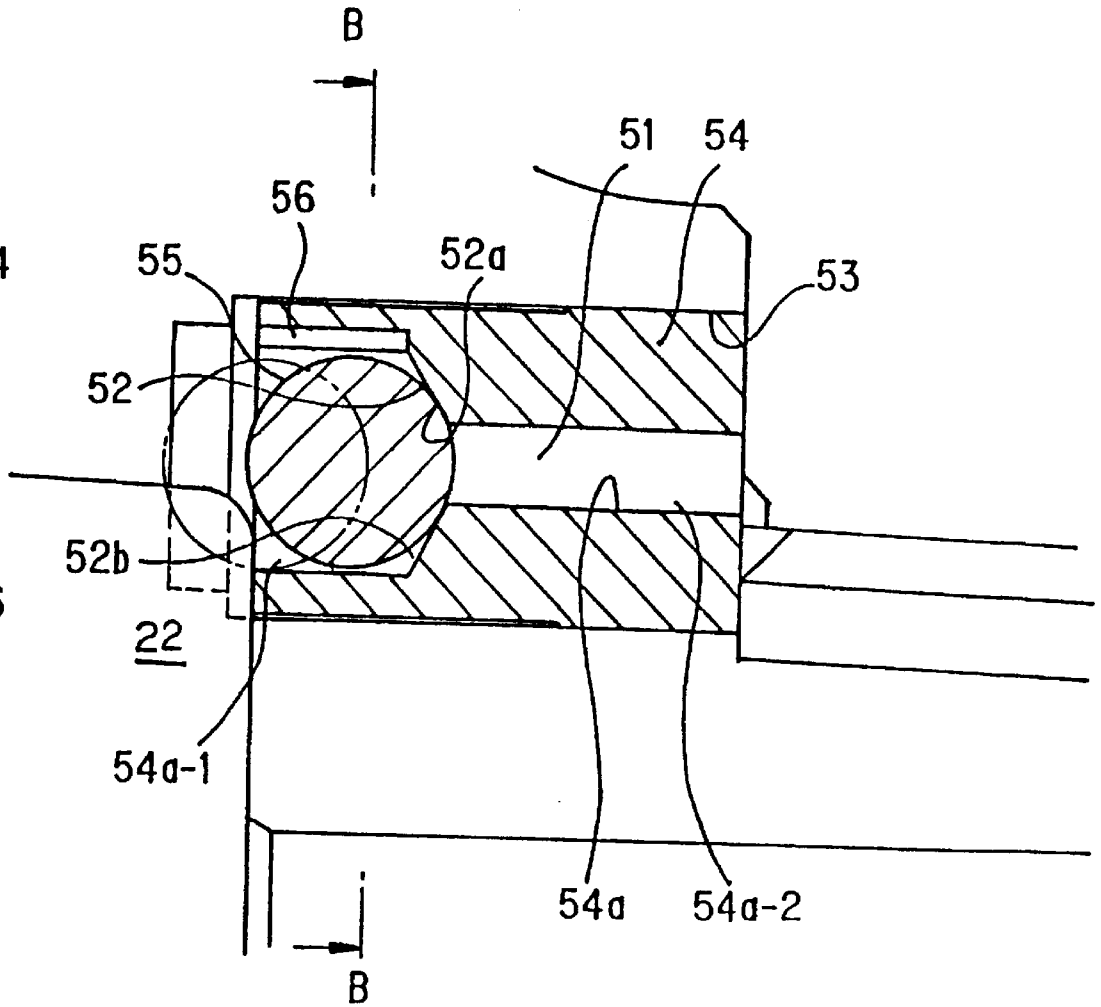
FIG. 6A and FIG. 6B are an explanatory views showing another embodiment of the pressure control valve according to the present invention.
Figure 6A:
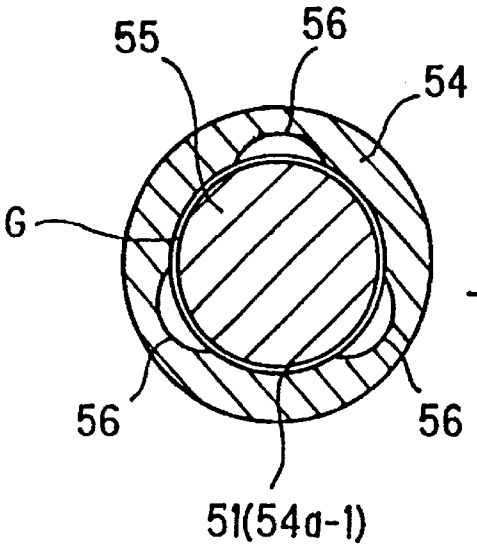

In the pressure control valve 50 shown in FIGS. 5A 5B, only one groove 56 is formed on the inner wall of the communication passage 51 as a means for partially expanding the minute gap G. However, as shown in FIGS. 6A 6B, a plurality of such grooves 56 may be formed radially on the inner wall of the communication passage 51 as means for expanding the minute gap G at several locations.

When there exists only one groove 56 on the inner wall of the communication passage 51 as shown in FIG. 5A, it is required that the groove 56 be properly arranged in the upper region of the minute gap G in order that the oil film breaking effect of the groove 56 be effectively exhibited. However, with a structure in which a plurality of the grooves 56 are formed radially on the inner wall of the communication passage 51 as shown in FIG. 6A, since at least one of the grooves 56 is arranged proximal to the upper region of the minute gap G, the intended function of the groove 56, namely the oil film breaking function thereof, can be attained in a stable manner even without performing a strict control of the arrangement positions.

In the pressure control valve 50 shown in FIGS. 3, 5A 5B, and 6A 6B, there is adopted a structure in which almost the entirety of the communication passage is constituted by the cylindrical bush 54. However, a structure of the communication passage 51 such as shown in FIG. 7A may alternatively be adopted.

Figure 7B:
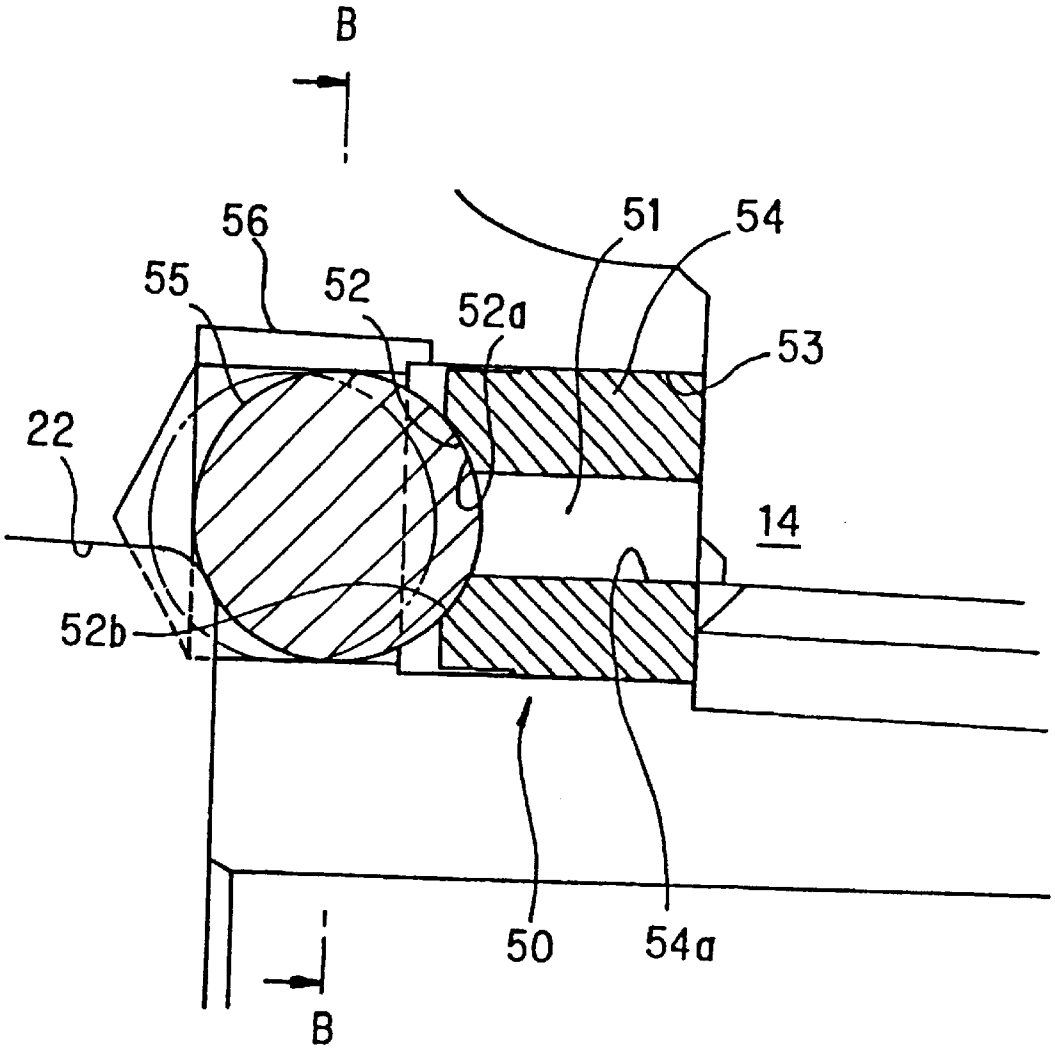
FIG. 7A and FIG. 7B are an explanatory views showing another embodiment of the pressure control valve according to the present invention.
Figure 7A:
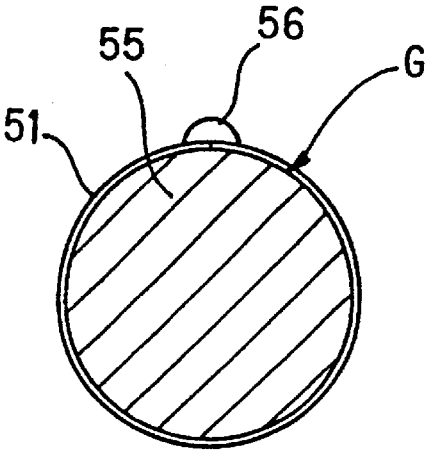

That is, in a pressure control valve 50 shown in FIGS. 7A 7B, there is adopted a structure such that, in a through hole 53 piercing from the suction chamber 14 to the scoop groove 22, a short cylindrical bush 54 having a length half which is about that of the through hole 53 is disposed, and the communication passage 51 is constituted of a cylinder hollow hole 54*a* of this cylindrical bush 54 and a front portion of the through hole 53 located beyond the cylindrical bush 54. Further, in this structure of the communication passage 51, the open end of the cylindrical bush 54 is cut out in a bowl-like shape to form a hole 52 having a shape of a circular truncated cone. Also, of both open ends 52*a*, 52*b* of the hole 52 having a circular truncated cone, a valve body 55 disposed within the communication passage 51 is located on the side of the open end 52*b* having a large diameter, and may be fitted into the hole 52 having a shape of a circular truncated cone from this position.

Also in the case of the pressure control valve 50 shown in FIGS. 7A 7B, a minute gap G is formed between the valve body 55 and the communication passage 51 and a groove 56 is provided as a means for partially expanding this minute gap G. Due to the aforementioned structure of the communication passage 51, the groove 56 is formed on an inner surface of the through hole 53 in the front portion thereof past the cylindrical bush 54. Note that, as in the aforementioned embodiments, the groove 56 is formed along the direction of movement of the valve body 55 and functions as a means for breaking off an oil film formed about the periphery of the valve body 55.

The valve body 55 having a shape of a steel ball is adopted in the pressure control valve 50 shown in FIGS. 3, and 5A 5B to 7A 7B. However, a structure of the valve body 55 such as shown in FIGS. 8A 8B may alternatively be adopted.

Figure 8B:
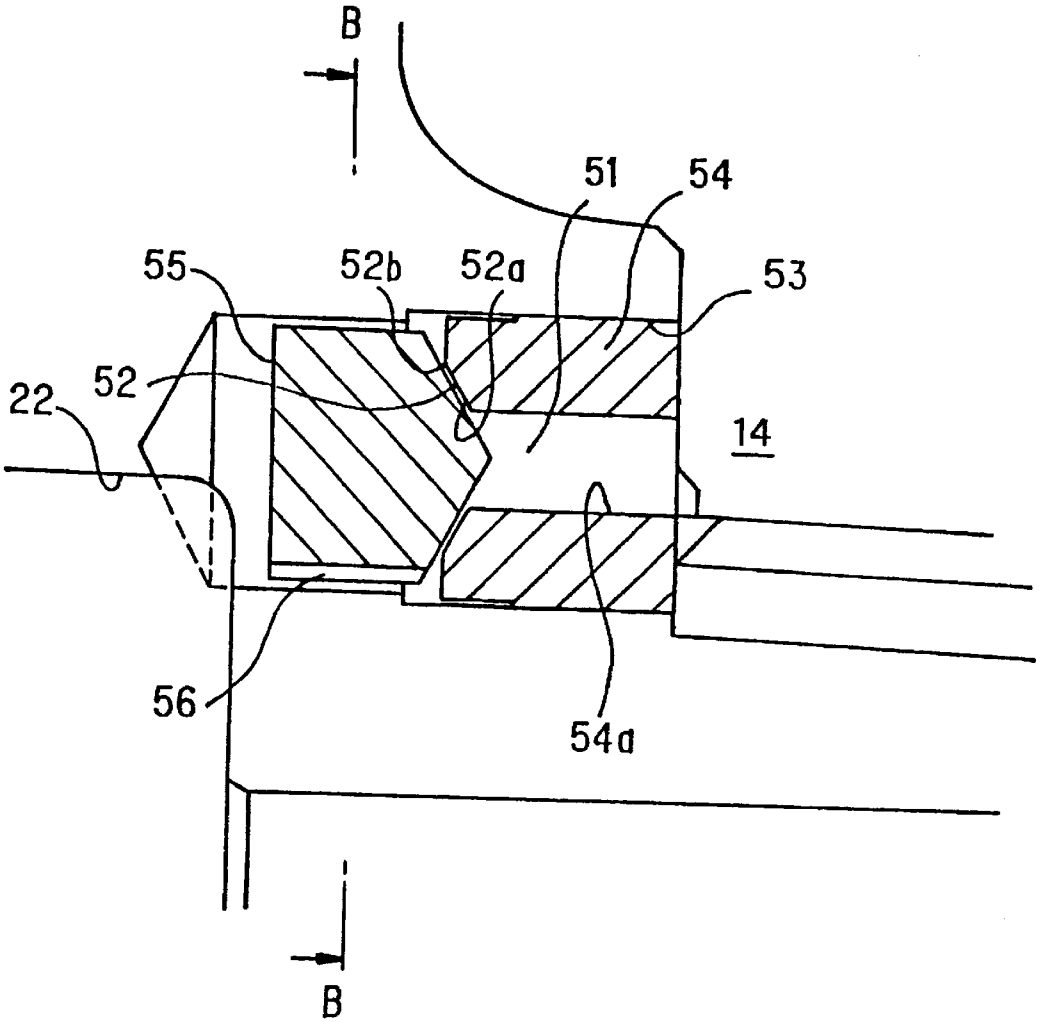
FIG. 8A and FIG. 8B are an explanatory views showing another embodiment of the pressure control valve according to the present invention.
Figure 8A:
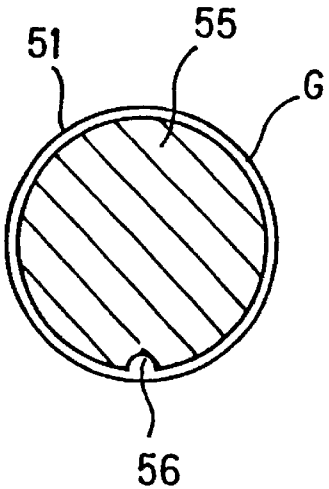

A valve body 55 shown in FIGS. 8A 8B has a configuration such that a sealing surface of a circular cone shape is formed at the tip end portion thereof. When adopting such a valve body 55 including a sealing surface of a circular cone shape, although it is possible to form a groove 56 as width extending means on an inner wall of a communication passage 51, the groove 56 may be formed on an outer peripheral surface of the valve body 55 as shown in FIGS. 8A 8B. With this structure, the width of the minute gap G can be extended by means of the groove 56 thus formed on the outer peripheral surface of the valve body 56, thereby making it possible to attain the same effect as those obtained in the aforementioned embodiments. Moreover, there is an additional advantage such that generation of burrs, which is usually observed when performing processing to form the groove within the hole, can be obviously avoided and thus the need to perform a control with respect to foreign matters such as burrs is eliminated.

In the pressure control valve 50 shown in FIGS. 5A 5B through 8A 8B, there is adopted a structure in which the oil film formed about the periphery of the valve body 55 is broken off by means of the groove 56 (width extending means) in order to avoid occurrence of a phenomenon such that the communication passage 51 is blocked or the valve body 55 is stuck (adheres) to the hole 52 due to the oil film. However, as a measure against such sticking (adhering) phenomenon, a structure such as shown in FIGS. 9A 9B, for example, may be adopted in addition to the above structure.

Figure 9B:
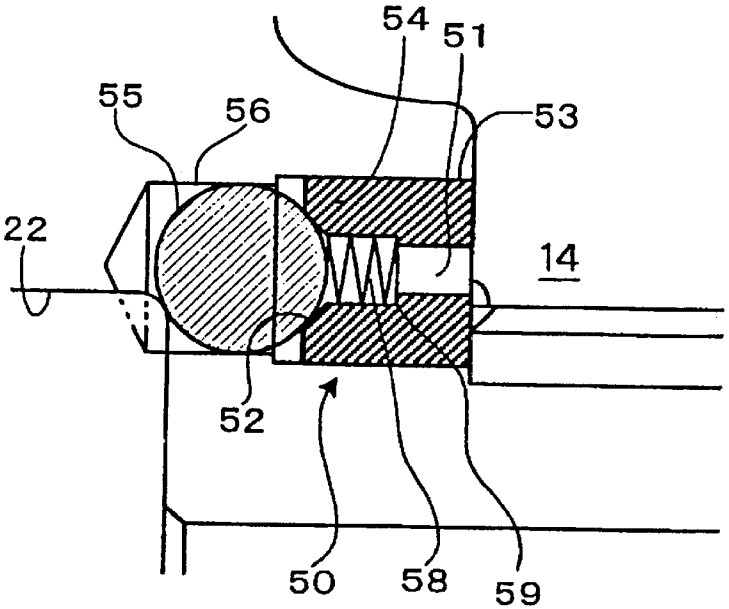
FIG. 9A and FIG. 9B are an explanatory views showing another embodiment of the pressure control valve according to the present invention.
Figure 9A:
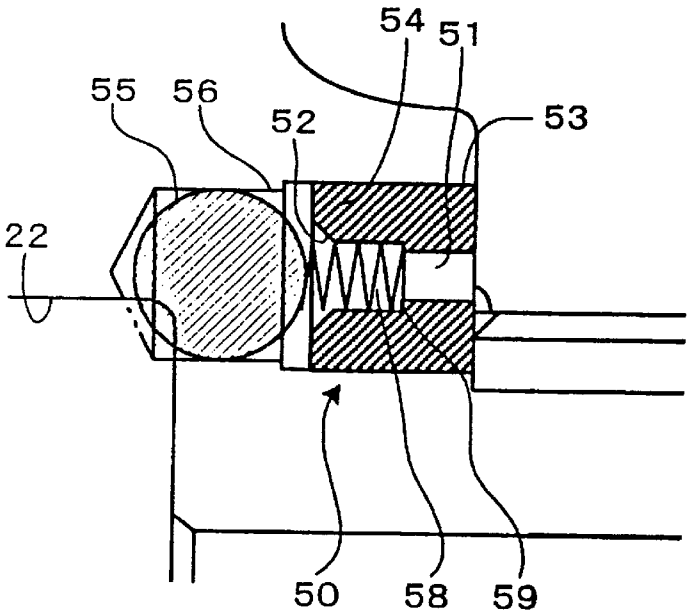

A pressure control valve 50 shown in FIGS. 9A 9B is different from that shown in FIGS. 5A 5B and so on in that a coil spring 58 is provided as a biasing means within the communication passage 51. This coil spring 58 is disposed within the communication passage 51 and is adapted to constantly bias the valve body 55 in a direction for moving the valve body 55 away from the hole 52 having a shape of a circular truncated cone (i.e., in a direction to open the communication passage 51). Further, the biasing force of the coil spring 58 is set to be greater than the adhesive force of the oil film for sticking the valve body 55 to the hole 52 having a shape of a circular truncated cone.

With the pressure control valve 50 of FIGS. 9A 9B having the coil spring 58 as described above, if the pressure in the suction chamber 14 is lower than the pressure in the scoop groove 22, as shown in FIG. 9B, due to the pressure difference between the both chambers 14, 22, the valve body 55 is pushed into the hole 52 having a shape of the circular truncated cone while resisting the biasing force of the coil spring 58 to thereby close the communication passage 51. If, however, the pressure relationship between the both chambers 14, 22 is reversed, as shown in FIG. 9A, due to the pressure difference between the both chambers 14, 22 produced by the reversion of the pressures and the biasing force of the coil spring 58, the valve body 55 is moved apart from the hole 52 having a shape of a circular truncated cone to thereby open the communication passage 51.

Also, in the pressure control valve 50 shown in FIGS. 9A 9B, when the pressures in the scoop groove 22 and the suction chamber 14 are equal to each other, the valve body 55 overcomes the adhesive force of the oil film due to the biasing force of the coil spring 58 and thus moves apart from the hole 52 having a shape of a circular truncated cone. Thus, it is possible to effectively prevent a phenomenon such that the valve body 55 adheres to the hole 52 having a shape of a circular truncated cone due to the oil film when such equality between the pressures exist. Therefore, with the pressure control valve 50 shown in the drawing, when the pressure within the suction chamber 14 becomes even slightly higher than the pressure within the scoop groove 22, the valve body 55 can quickly respond to the slight pressure reversion phenomenon to immediately equalize the pressures between the both chambers 22, 14.

Note that, in the pressure control valve according to the aforementioned embodiments, there is adopted a structure in which it includes either the width extending means (groove 56) or the biasing means (coil spring 58). However, the pressure control valve of this kind may also be constructed so as to include both the width extending means and the biasing means.

Further, although the coil spring 58 is adopted as the biasing means in the aforementioned embodiments, the biasing means of this kind is not limited to the coil spring. An elastic member having the same function as that of the coil spring may alternatively be adopted.

In the gas compressor according to the present invention, when arranging the scoop groove and the high pressure supply hole so as to be spaced apart from each other as described above, an interval therebetween is set to an interval sufficient to ensure that the vane groove is communicated with neither the scoop groove nor the high pressure supply hole while it moves apart from the scoop groove toward the high pressure supply hole side. Thus, since the vane groove is communicated with neither of the scoop groove and the high pressure supply hole while it moves apart from the scoop groove toward the high pressure supply hole, high pressure supply oil does not flow into the scoop grooves side from the high-pressure hole side through the vane groove during a steady operation of the compressor, thereby preventing an increase in the oil pressure within the scoop groove due to the high-pressure oil flowing thereto and a resulting increase in the vane back pressure. Therefore, abrasion of the vanes is lessened and thus the durability of the apparatus is improved, and the power required for operating the gas compressor of this kind is reduced (i.e., power saving is realized) and therefore saving is realized in terms of fuel consumption.

Further, in the case where the non-interconnecting structure such as described above is adopted, when the stopped position of the vane groove upon stopping the operation of the gas compressor is located between the scoop groove and the high pressure supply hole, the bottom portion of the vane groove is communicated with neither the scoop groove nor the high pressure supply hole. Thus, the vane back pressure at the bottom portion of the vane groove can be maintained at a relatively high level during the stoppage of the operation of the gas compressor. In this way, the projectability of the vanes upon starting the operation of the gas compressor can be improved also by adopting the non-interconnecting structure.

Further, in the gas compressor according to the present invention, there is provided a pressure control valve that acts to interconnect the scoop groove with the low-pressure chamber side when there exists the reversed pressure relationship between the low-pressure chamber and the high-pressure chamber as described above. Thus, even if, for example, such reversed pressure relationship exists at the time of starting the operation of the gas compressor, since the pressure control valve acts to introduce a relatively high pressure gas from the low-pressure chamber into the scoop groove through the communication passage, the pressure within the scoop groove and the vane back pressure can readily rise upon starting the operation of the compressor. Thus, projectability of the vanes upon starting the operation of the compressor is improved, and therefore there is attained enhanced starting performance of the gas compressor. Accordingly, no wasteful consumption of power occurs at the time of starting the operation of the compressor, which also contribute to savings in terms of power and fuel consumption.

What is claimed is:

1. A gas compressor comprising:

a cylinder having side blocks attached to its end surface;

a rotor rotatably disposed within the cylinder;

vanes which slide within a vane groove formed on an outer peripheral surface of the rotor and which is arranged so as to be projectable from the outer peripheral surface of the rotor toward an inner peripheral surface of the cylinder;

a compression chamber constituted by a small chamber that is partitioned off and defined in the interior of the cylinder by the cylinder, the side block, the rotor, and the vanes, which alternately increases and decreases in volume as the rotor rotates, and sucks in a refrigerant gas in a low-pressure chamber due to the volume variation to compress and then discharge it into a high-pressure chamber side;

a scoop groove with which a bottom portion of the vane groove communicates during a suction and compression process of the refrigerant gas and from which a vane back pressure is supplied into the bottom portion of the vane groove;

a high pressure supply hole with which the bottom portion of the vane groove communicates at a time immediately before discharge of the refrigerant gas and from which a vane back pressure having a pressure higher than the vane back pressure supplied from the scoop groove is supplied into the bottom portion of the vane groove; and a pressure control valve which interconnects the scoop groove with a low-pressure chamber side when there has occurred a reversed pressure relationship between the low-pressure chamber and the high-pressure chamber, wherein the scoop groove and the high pressure supply hole are arranged so as to be spaced apart from each other, and an interval therebetween is set to an interval sufficient to ensure that the vane groove is communicated with neither the scoop groove nor the high pressure supply hole.

2. A gas compressor according to claim 1, wherein:

the pressure control valve comprises:

a communication passage communicating the suction chamber with the scoop groove;

a hole having a shape of a circular truncated cone, which is arranged as a valve seat portion in the communication passage;

a valve body which is movably disposed within the communication passage and which is formed such that it may be fitted into the hole having a shape of a circular truncated cone; and width extending means for partially extending a width of a minute gap between the valve body and the communication passage; and when the pressure in the suction chamber has become higher than the pressure in the scoop groove, the valve body is set in the communication passage in an opened state, whereas when the pressure in the scoop groove has risen to exceed the pressure in the suction chamber, the valve body is set in the communication passage in a closed state.

3. A gas compressor according to claim 2, wherein the width extending means extends the width of the minute gap in an upper region thereof, out of the entire area of the minute gap.

4. A gas compressor according to claim 2, wherein the width extending means extends the gap of the minute gap at several locations.

5. A gas compressor according to claim 2, wherein the width extending means is constituted by a groove formed on an inner wall of the communication passage along a direction of movement of the valve body.

6. A gas compressor according to claim 2, wherein the width extending means is constituted by a groove formed on an outer peripheral surface of the valve body.

7. A gas compressor according to claim 1, wherein the pressure control valve comprises:

a communication passage communicating the suction chamber with the scoop groove;

a hole having a shape of a circular truncated cone, which is arranged as a valve seat portion in the communication passage;

a valve body which is movably disposed within the communication passage, and which is formed such that it fits into the hole having a shape of a circular truncated cone; and biasing means that constantly biases the valve body in a direction to move the valve body away from the hole having a shape of a circular truncated cone; and when the pressure in the suction chamber has become higher than the pressure in the scoop groove, the valve body is set in the communication passage in an opened state, whereas when the pressure in the scoop groove has risen to exceed the pressure in the suction chamber, the valve body is set in the communication passage in a closed state.

8. A gas compressor according to claim 7, wherein a biasing force applied by the biasing means is greater than an adhesive force of an oil film that adheres the valve body to the hole having a shape of a circular truncated cone.

9. A gas compressor according to claim 1, wherein the pressure control valve comprises:

a communication passage communicating the suction chamber with the scoop groove;

a hole having a shape of a circular truncated cone, which is arranged as a valve seat portion in the communication passage;

a valve body which is movably disposed within the communication passage, and which is formed such that it fits into the hole having a shape of a circular truncated cone;

width extending means for partially extending a width of a minute gap between the valve body and the communication passage; and biasing means that constantly biases the valve body in a direction to move the valve body away from the hole having a shape of a circular truncated cone; and when the pressure in the suction chamber has become higher than the pressure in the scoop groove, the valve body is set the communication passage in an opened state, whereas when the pressure in the scoop groove has risen to exceed the pressure in the suction chamber, the valve body is set in the communication passage in a closed state.

10. A gas compressor according to claim 9, wherein the width extending means extends the width of the minute gap in an upper region thereof, out of the entire area of the minute gap.

11. A gas compressor according to claim 9, wherein the width extending means extends the gap of the minute gap at several locations.

12. A gas compressor according to claim 9, wherein the width extending means is constituted by a groove formed on an inner wall of the communication passage along a direction of movement of the valve body.

13. A gas compressor according to claim 9, wherein the width extending means is constituted by a groove formed on an outer peripheral surface of the valve body.

14. A gas compressor according to claim 9, wherein a biasing force applied by the biasing means is greater than an adhesive force of an oil film that adheres the valve body to the hole having a shape of a circular truncated cone.

* * * * *